US006694519B1

(12) United States Patent
Stewart

(10) Patent No.: US 6,694,519 B1
(45) Date of Patent: Feb. 24, 2004

(54) DEVICE AND METHOD FOR SUPPORTING THE WRIST AND HAND OF A COMPUTER USER

(76) Inventor: Edward B. Stewart, 110 Brandywine Pl., S.W., Washington, DC (US) 20032

( * ) Notice: Subject to any disclaimer, the term of this patent is extended or adjusted under 35 U.S.C. 154(b) by 0 days.

(21) Appl. No.: 10/308,041

(22) Filed: Dec. 3, 2002

(51) Int. Cl.[7] ..... A41D 13/00
(52) U.S. Cl. ..... 2/20; 602/21
(58) Field of Search ..... 2/16, 20, 158, 2/159, 160, 161.6, 162, 164, 170; 602/21, 22, 63, 64

(56) References Cited

U.S. PATENT DOCUMENTS 4,832,010 A * 5/1989 Lerman ..... 602/63
5,058,573 A * 10/1991 Hess et al. ..... 602/21
5,404,591 A * 4/1995 Brinnand et al. ..... 2/20
5,810,753 A * 9/1998 Eberbach ..... 602/21
6,120,472 A * 9/2000 Singer, Jr. ..... 602/64
6,213,969 B1 * 4/2001 MacMorran et al. ..... 602/64
6,517,507 B1 * 2/2003 Faherty ..... 602/64

* cited by examiner

*Primary Examiner*—Gary L. Welch
(74) *Attorney, Agent, or Firm*—Antonelli, Terry, Stout & Kraus, LLP

(57) ABSTRACT

A device for and a method of supporting a wrist and hand of a computer user as the user operates a computer mouse. A sleeve member has a length sufficient to cover at least a portion of the wrist and hand of the user and has sufficient elasticity to permit it to grippingly engage the portion of the wrist and hand so as to permit the device to support the wrist and hand of the user as the user operates the computer mouse. In one embodiment, the sleeve member has a cushion within a defined section. By positioning the defined section adjacent the underside of the wrist and the heel of the hand, the wrist and hand are significantly elevated from the support surface by the cushion, thus improving the comfort of the user of the computer mouse and lessening the likelihood of an ailment such a carpal tunnel syndrome.

13 Claims, 1 Drawing Sheet

DEVICE AND METHOD FOR SUPPORTING THE WRIST AND HAND OF A COMPUTER USER

FIELD OF THE INVENTION

The present invention pertains to a device for and a method of supporting a wrist or a wrist and hand of a computer user as the user operates a computer mouse. In addition, the present invention pertains to a method of operating a computer mouse using the device.

BACKGROUND OF THE INVENTION

Computers are widely used both in business and industry and for personal use. Many people use computers for extensive hours in their employment. Much of this work involves using a computer mouse to cause various actions to take place. By way of example, persons preparing drawings by computerized drafting and people doing computer assisted design work frequently spend several hours a day operating a computer mouse. Prolonged use of a computer mouse is tiring to the wrist and hand of the user and can lead to such difficulties as carpal tunnel syndrome. It has been found that if the wrist or wrist and hand of the computer user are supported at a slightly higher level than the surface on which the mouse is operated, fewer problems of tiring and disability may be encountered.

Mouse pads are known which include a raised portion at the front of the pad for supporting the wrist or wrist and hand of the user. However, this raised portion frequently is not fixedly adhered to the surface of the mouse pad, and so might be displaced. Further, the user might wish to move the mouse to a position on the mouse pad in which the wrist or wrist and hand are no longer supported by the raised portion. Further, someone who moves to different computers, for example a temporary employee, might sometimes be called upon to work at a computer which does not have a support for the wrist or wrist and hand.

It has been known to use a wrist sweatband, such as frequently worn by athletes or by persons engaging in fitness exercises, on the wrist to elevate the wrist during operation of the computer mouse. Such sweatbands are generally fairly thin and narrow, and so provide only limited support of the wrist of the computer user.

SUMMARY OF THE INVENTION

The present invention is a device for and method of supporting a wrist or a wrist and hand of a computer user as the user operates a computer mouse on a support surface. The present invention is also a method of operating a computer mouse using the device. In accordance with the present invention, a device for supporting a wrist or wrist and hand of a computer user includes a sleeve member having a length sufficient to cover at least a portion of the wrist or the wrist and hand of the user and a circumference sufficient to encircle that portion. The sleeve member has sufficient elasticity to permit it to be moved over the hand of the user and onto the portion of the wrist or the wrist and heel of the hand and to grippingly engage that portion so as to permit the device to support the wrist or the wrist and hand of the user on the support surface as the user operates the computer mouse.

In preferred embodiments, the sleeve member has a defined first section for overlying the underside of the encircled portion of the wrist or the wrist and heel of the hand during operation of the computer mouse and a defined second section for overlying the upper side of the encircled portion, and one of the first section and the second section of the sleeve member includes a cushion. By positioning the defined section having the cushion adjacent the underside of the wrist or the wrist and heel of the hand, the wrist or the wrist and hand are significantly elevated from the support surface by the cushion, thus improving the comfort of the user of the computer mouse and lessening the likelihood of an ailment such a carpal tunnel syndrome. However, if the user prefers, the sleeve member can be placed on the wrist or the wrist and hand with the defined section having the cushion adjacent the upper surface of the wrist or wrist and hand so that only the thickness of the uncushioned sleeve member supports the wrist or wrist and hand.

The method of supporting a wrist or wrist and hand of a computer user as the user is operating a computer mouse on a support surface in accordance with the present invention includes placing at least a portion of the wrist or the wrist and hand of the user within a sleeve member having a length sufficient to cover the portion of the wrist or wrist and hand and a circumference sufficient to encircle the portion of the wrist or wrist and hand and having sufficient elasticity to permit the sleeve member to be moved over the hand of the user and onto the portion of the wrist or the wrist and hand and to grippingly engage that portion. The sleeve member has a defined section which in one preferred embodiment includes a cushion. The defined section is placed on the support surface to support the wrist or wrist and hand of the user during operation of the computer mouse. The present invention further includes a method of operating a computer mouse on a support surface while having the above device on the wrist or the wrist and hand.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings:

DETAILED DESCRIPTION OF PREFERRED EMBODIMENTS

Figure 1:
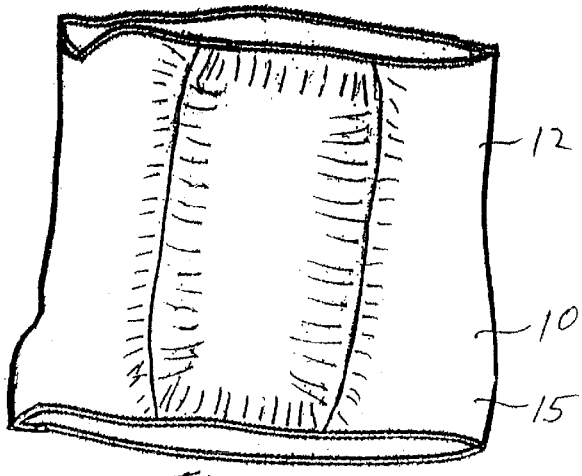
FIG. 1 is a perspective view of a device for supporting a wrist or wrist and hand of a computer user in accordance with a first embodiment of the present invention.
Figure 2:
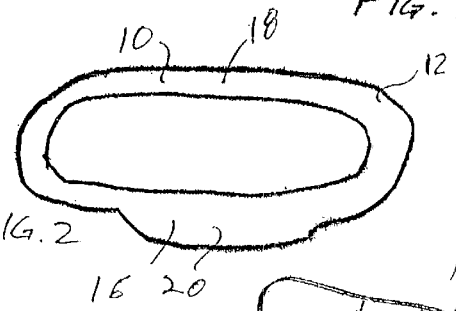
FIG. 2 is an end elevational view of the device of FIG. 1.
Figure 3:
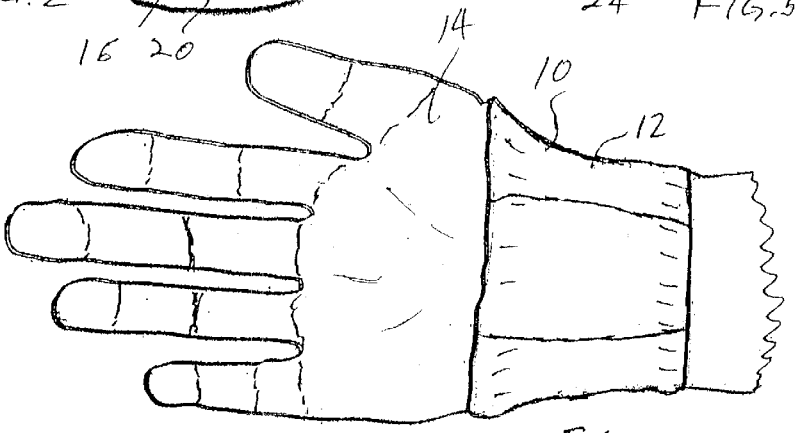
FIG. 3 is a fragmentary underside view of a wrist and hand of a computer user utilizing the device of FIG. 1.

FIGS. 1 and 2 depict a device 10 for supporting a wrist or a wrist and hand of a computer user as the user operates a computer mouse on a support surface in accordance with a first embodiment of the present invention. Device 10 includes a sleeve member 12 having a length sufficient to cover at least a portion of the wrist or the wrist and heel of the hand of the computer user, as illustrated in FIG. 3. Sleeve member 12 has a circumference sufficient to encircle the portion of the wrist or wrist and heel of the hand and has sufficient elasticity to permit the sleeve member to be moved over the hand 14 of the user and onto the portion of the wrist and heel of the hand so as to permit the device 10 to support the wrist and hand of the user on a support surface as the user operates a computer mouse. As depicted in FIG. 1, if desired one end 15 of sleeve member 12 may have a slightly greater circumference so as to fit snuggly over the heel of the hand while the remainder of the sleeve member is sized to fit snuggly over the wrist.

Sleeve member 12 includes a first section 16 which may overlie the underside of the portion of the wrist or the wrist and the heel of the hand during operation of the computer mouse and a second section 18 which may overlie the upperside of the portion of the wrist or the wrist and heel of the hand during operation of the computer mouse. One of the first section and the second section of the sleeve member includes a cushion 20, depicted in FIGS. 2 and 3 as being included in the first section 16. Cushion 20 thus supports the wrist and hand of the computer user at an elevation above the surface on which the computer mouse is operated sufficient to decrease discomfort caused by prolonged use of the mouse. On the other hand, should the user prefer, sleeve member 12 can be positioned with cushion 20 overlying the upper surface of the wrist or the wrist and heel of the hand so that only second portion 18 of the sleeve member supports the wrist and hand.

Sleeve member 12 is a circular, tube-shape member and can be provided in appropriate sizes to fit different sizes of wrist. By way of example, for an adult computer user the device 10 might be provided in a small size having a circumference in the order of about six inches, a medium size having a circumference in the order of about seven inches, and a large size having a circumference in the order of about eight inches. Larger or smaller sizes might also be provided. Each might be provided with a length in the order of about two to four inches so as to fit on a portion of the user's wrist and heel of the hand. For children the device might be provided in smaller sizes.

Sleeve member 12 can be made of any suitable material. By way of examples, sleeve member 12 may be made of a knitted or woven material, including synthetic materials, such as rayon or polyester, and natural materials such as cotton or wool. Likewise, sleeve member 12 can be formed of a blend of synthetic and natural materials or might be formed of rubber. Cushion 20 might be formed during the formation of device 10 as an integral part of sleeve member 12, or might be a separate component enclosed within defined section 16 of the sleeve member. Device 12 can be provided in a variety of colors to suit the preferences of different computer users.

Figure 4:
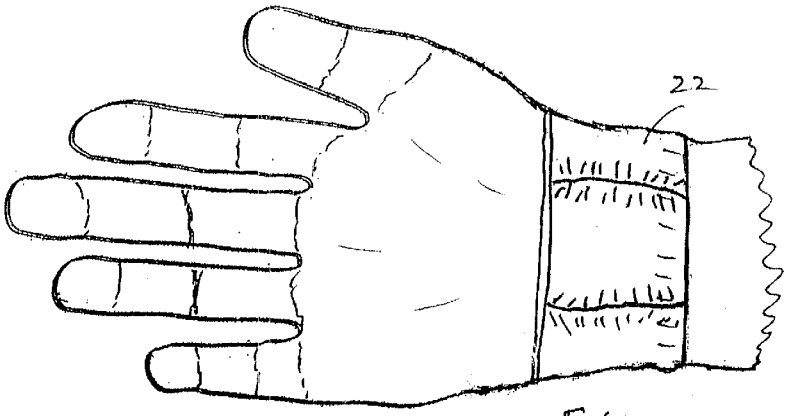
FIG. 4 is a fragmentary underside view of a wrist and hand of a computer user utilizing a second embodiment of a device for supporting a wrist and hand of the user in accordance with the present invention.

FIG. 4 illustrates a device 22 in accordance with a second embodiment of the present invention. Device 22 differs from device 10 of FIG. 3 by being shorter so as to overlie only a portion of the user's wrist.

Figure 5:
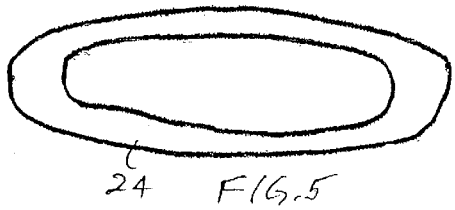
FIG. 5 is an end elevational view of another embodiment of a device for supporting a wrist and hand of a computer user in accordance with the present invention.

FIG. 5 is an end view of a device 24 in accordance with a further embodiment of the present invention. Device 24 omits cushion 20 within the sleeve member and is particularly suitable for a longer device designed to be positioned over a portion of the wrist and the heel of the hand, as in FIG. 3.

Although the present invention has been described with reference to preferred embodiments, various alterations, rearrangements, and substitutions could be made, and still the result would be within the scope of the invention.

What is claimed is:

1. A device for supporting a wrist and hand of a computer user as the user operates a computer mouse on a support surface, said device comprising:

a sleeve member having a length sufficient to cover at least a portion of the wrist and heel of the hand of the user and a circumference sufficient to encircle the portion of the wrist and heel of the hand and having sufficient elasticity to permit said sleeve member to be moved over the hand of the user and onto the portion of the wrist and heel of the hand and to grippingly engage the portion of the wrist and heel of the hand so as to permit said device to support the wrist and hand of the user on the support surface as the user operates the computer mouse, wherein:

said sleeve member has a first section for overlying the underside of the portion of the wrist and heel of the hand during operation of the computer mouse and a second section for overlying the upperside of the portion of the wrist and heel of the hand during operation of the computer mouse; and one of said first section and said second section of said sleeve member is thickened to provide a cushion formed integrally with said section of said sleeve member.

2. A device as claimed in claim 1, wherein said sleeve member is formed of a woven material.

3. A device as claimed in claim 1, wherein said sleeve member is formed of a knitted material.

4. A device as claimed in claim 1, wherein said sleeve member is formed of a synthetic material.

5. A device as claimed in claim 1, wherein said sleeve member is formed of a natural material.

6. A device as claimed in claim 1, wherein said sleeve member is formed of a blend of a synthetic material and a natural material.

7. A device as claimed in claim 1, wherein said sleeve member includes a first end having a first circumference and a second end having a second circumference greater than the first circumference.

8. A device for supporting a wrist of a computer user as the user operates a computer mouse on a support surface, said device comprising:

a sleeve member having a length sufficient to cover at least a portion of the wrist of a hand of the user and a circumference sufficient to encircle the portion of the wrist and having sufficient elasticity to permit said sleeve member to be moved over the hand of the user and onto the portion of the wrist and to grippingly engage the portion of the wrist so as to permit said device to support the wrist of the user on the support surface as the user operates the computer mouse, said sleeve member having a first section for overlying the underside of the portion of the wrist during operation of the computer mouse and a second section for overlying the upperside of the portion of the wrist during operation of the computer mouse, wherein:

one of said first section and said second section of the sleeve member is thisckened to provide a cushion formed integrally with said section of said sleeve member.

9. A device as claimed in claim 8, wherein said sleeve member is formed of a woven material.

10. A device as claimed in claim 8, wherein said sleeve member is formed of a knitted material.

11. A device as claimed in claim 8, wherein said sleeve member is formed of a synthetic material.

12. A device as claimed in claim 8, wherein said sleeve member is formed of a natural material.

13. A device as claimed in claim 8, wherein said sleeve member is formed of a blend of synthetic and natural materials.

* * * * *